US008746707B2

(12) United States Patent
Zampieri

(10) Patent No.: US 8,746,707 B2
(45) Date of Patent: Jun. 10, 2014

(54) SKATE

(75) Inventor: Claudio Zampieri, Tombolo (IT)

(73) Assignee: Tecnica Group S.p.A., Giavera del Montello (TV) (IT)

( * ) Notice: Subject to any disclaimer, the term of this patent is extended or adjusted under 35 U.S.C. 154(b) by 273 days.

(21) Appl. No.: 13/224,495

(22) Filed: Sep. 2, 2011

(65) Prior Publication Data

US 2012/0056390 A1 Mar. 8, 2012

Related U.S. Application Data

(63) Continuation-in-part of application No. 12/715,066, filed on Mar. 1, 2010, now Pat. No. 8,292,307.

(30) Foreign Application Priority Data

Mar. 2, 2009 (EP) ..... 09425082

(51) Int. Cl.
*A63C 1/00* (2006.01)
*A63C 17/00* (2006.01)
*A63C 3/00* (2006.01)

(52) U.S. Cl.
USPC ..... 280/11.12; 280/841; 280/11.27

(58) Field of Classification Search
CPC ..... A63C 17/02; A63C 17/04; A63C 17/06; A63C 1/42; A63C 1/30; A63C 2203/42
USPC ..... 280/11.19, 11.221, 841, 11.231, 11.27, 280/11.12
See application file for complete search history.

(56) References Cited

U.S. PATENT DOCUMENTS

| | | | | |
|---|---|---|---|---|
| 1,866,134 | A | 7/1932 | Smith | |
| 3,866,927 | A * | 2/1975 | Tvengsberg | 280/11.12 |
| 4,008,901 | A * | 2/1977 | Conn | 280/7.13 |
| D275,218 | S * | 8/1984 | Chang | D21/761 |
| 4,932,675 | A * | 6/1990 | Olson et al. | 280/7.13 |
| 5,135,244 | A | 8/1992 | Allison | |
| 5,503,413 | A * | 4/1996 | Belogour | 280/11.225 |
| 5,853,179 | A | 12/1998 | Chapman | |
| 5,890,724 | A | 4/1999 | Gignoux et al. | |
| 6,161,846 | A | 12/2000 | Soderberg | |
| 6,186,518 | B1 | 2/2001 | Moses | |
| 6,446,984 | B2 | 9/2002 | Grande et al. | |
| 6,712,395 | B1 | 3/2004 | Lee | |
| 6,736,412 | B1 | 5/2004 | Krah | |
| 7,419,187 | B2 * | 9/2008 | Haugen et al. | 280/841 |
| 7,896,363 | B2 * | 3/2011 | Lovejoy | 280/7.13 |
| 2007/0063458 | A1 | 3/2007 | Bont | |
| 2009/0045596 | A1 | 2/2009 | Boucher | |

FOREIGN PATENT DOCUMENTS

| | | | |
|---|---|---|---|
| WO | 97/46291 | A1 | 12/1997 |
| WO | 2004/087270 | A1 | 10/2004 |

* cited by examiner

*Primary Examiner* — J. Allen Shriver, II
*Assistant Examiner* — James M Dolak
(74) *Attorney, Agent, or Firm* — Sughrue Mion, PLLC

(57) ABSTRACT

Skate, either an in-line roller skate or an ice skate, comprising a frame carrying on or more sliding elements, and a skate boot provided with a sole, said boot being fastened to said frame through a fastening portion, wherein said fastening portion is located between said sole and said frame in a substantially central region in the longitudinal direction of said frame.

3 Claims, 5 Drawing Sheets

SKATE

This is a continuation-in-part of U.S. patent application Ser. No. 12/715,066 filed Mar. 1, 2010, claiming priority based on European Patent Application No. 09425082.6 filed Mar. 2, 2009, the contents of all of which are incorporated herein by reference in their entirety.

TECHNICAL FIELD

The present invention relates to a skate.

According to a first aspect of the invention, the present invention relates to an in-line roller skate, in particular to a racing skate.

According to a second aspect of the invention, the present invention relates to an ice skate, either to an ice skate for figure skating or an ice skate for speed skating.

PRIOR ART

With particular reference to in-line skates, in-line racing skates are provided with wheels having an increased diameter with respect to skates commonly sold for leisure.

More particularly, according to the regulations of the International Speed Skating Committee (C.I.C.—Comité Internacional de Course), in-line roller skates can have up to six wheels and the maximum diameter of the wheels can reach 110 mm, while in-line roller skates commonly sold for leisure are provided with wheels having a diameter of about 80 mm.

In racing skates, the need is particularly felt for wheels having an increased diameter, in order to improve the skate performances during the race, namely in terms of power transmission and speed.

However, the increase in wheel diameter implies an increase in the frame height and in the distance of the skate boot from the sliding plane and, consequently, an increase in the distance of the user's centre of gravity from said plane, which involves a reduction in skate stability.

In order to keep both the frame height and the distance of the skate boot from the sliding plane limited, in Patent Application WO 97/46291 a skate is proposed which is provided with four aligned wheels, wherein the front and the rear wheels have an increased diameter, while the intermediate wheels have a smaller diameter. By mounting the skate boot on the skate frame at the intermediate wheels, the distance of said boot from the sliding plane can be kept limited.

Such a solution has evident drawbacks, since the use of wheels having different diameters can cause instabilities and vibrations, consequently inducing a loss of skate control and a lower efficiency in the thrust power.

With reference to FIG. 1, patent application WO 2004/087270 discloses an in-line roller skate 101 provided with wheels 108 all having an increased diameter. In order to keep both the frame height H and the distance of the sole 103 of the skate boot 102 from the sliding plane limited, the boot fastening means 105,111—instead of being arranged at the two central wheels—are provided at a greater distance from each other: more precisely, first fastening means 111 are provided between the first and the second wheel, in the toe region, while second fastening means 105 are provided between the second-last and the last wheel, in the heel region.

Thanks to the provision of the fastening means in the gap between adjacent wheels, a frame 104 having a height H that is substantially equal to the diameter of the wheels 108 can be obtained.

Nevertheless, the above-disclosed solution also has drawbacks.

More particularly, the increased distance between the fastening points of the skate boot to the frame (equal to about 170-210 mm) considerably increases the stiffness of the frame structure. An excessive stiffness of the skate can involve a low precision in driving the skate, especially when turning, since it is hard to make the skate easily follow bends having small curvature radii.

With particular reference to ice skates, ice skates usually comprise a frame carrying a blade and a boot mounted onto said frame.

In particular, according to known solutions, the skate boot is usually attached to the frame at the toe region and at the heel region.

Therefore, although the skate blade as such has a certain flexibility, so that it can slightly bend when turning, the presence of the skate boot attached at two distinct separate points increases the stiffness of the skate and deteriorate the blade flexibility.

An excessive stiffness of the skate can involve a low precision in driving the skate, especially when turning, since it is hard to make the skate easily follow bends having small curvature radii.

For instance, short-track skates according to known art have to be provided with curved blades, as—always due to excessive stiffness—skates having straight blades would not be capable of following the curvature of short-track rings. The need for providing curved blades makes the manufacturing process more complex and expensive.

The main object of the present invention is to provide a solution alternative to prior art, which allows to obtain a skate having an improved precision in driving, while guaranteeing a high stability.

Another object of the present invention is to provide a skate allowing the user to easily manage bends having small curvature radii.

A further object of the present invention is to provide a skate with improved performances in terms of power transmission and speed.

These and other objects are achieved by a skate according to the invention, as claimed in the appended claims.

DISCLOSURE OF THE INVENTION

In general, according to the invention, the skate comprises a frame carrying one or more sliding elements and a boot, wherein the skate boot is fastened to the skate frame through a fastening portion provided between the sole of said boot and said frame in a substantially central region in the longitudinal direction.

In particular, according to a first aspect of the invention, the boot of an in-line roller skate is fastened to the skate frame through a fastening portion provided between the sole of said boot and said frame in a substantially central region in the longitudinal direction between the front wheel and the rear wheel.

Thanks to this arrangement, the boot sole can be placed substantially almost contacting the upper profile of the wheels, thus reducing the height of the skate centre of gravity with respect to the sliding plane.

Moreover, always thanks to the arrangement of the invention, the frame can have a vertical size reduced with respect to the wheels diameter, thus reducing the frame weight and, consequently, the skate overall weight.

The frame size reduction further implies a benefit in manufacturing costs, particularly when the frame material is especially expensive.

According to a second aspect of the invention, the boot of an ice skate is fastened to the skate frame through a fastening portion provided between the sole of said boot and said frame in a substantially central region in the longitudinal direction between the front end of the skate blade and the rear end of the skate blade.

Thanks to this arrangement, the presence of the boot does not deteriorate the flexibility of the skate blade.

Thanks to its reduced stiffness, the skate of the invention can easily follow bends having small curvature radii.

In particular, by adopting the arrangement of the invention it is advantageously possible to manufacture short-track skates with straight blades, avoiding the need for mounting curved blades.

Always thanks to the arrangement of the invention, the stability of the skate is also increased. This turns out to be particularly advantageous in ice skates for speed skating having longer blades.

BRIEF DESCRIPTION OF THE DRAWINGS

Advantages and features of the invention will be evident from the following description of a preferred embodiment of the invention, given by way of non-limiting example, with reference to the attached drawings, wherein.

DESCRIPTION OF A PREFERRED EMBODIMENT OF THE INVENTION

With reference to FIGS. 2 to 5, the in-line roller skate 1 according to the invention comprises a frame 5 including a pair of side frame elements 5*a*,5*b*, joined to each other by at least one transversal frame element 5*c*, wherein said frame elements can be made of metal, for instance aluminium, and said side frame elements 5*a*,5*b* are preferably made as perforated, shaped plates.

A front wheel 7*a*, a rear wheel 7*b* and one or more (two in the illustrated embodiment) intermediate wheels 7*b*,7*c* are pivotally mounted between said side frame elements 5*a*,5*b*, said wheels being arranged in-line and preferably all having the same diameter D.

A skate boot 3 provided with a sole 3*a* and suitable to be worn by the user of the skate 1 is fastened to said frame 5 through a fastening portion F.

According to the invention, said fastening portion F is fastened to the frame 5 at a region F that is substantially central in the longitudinal direction between the front wheel 7*a* and the rear wheel 7*d* of the skate.

Always according to the invention, said fastening portion F is advantageously located at the gap provided between the central wheels, i.e. between the two intermediate wheels 7*b* and 7*c* in the illustrated example wherein the skate has four aligned wheels.

Moreover, according to this preferred embodiment of the invention, said boot 3 is fastened to the frame 5 exclusively through said central fastening portion F.

Figure 1:
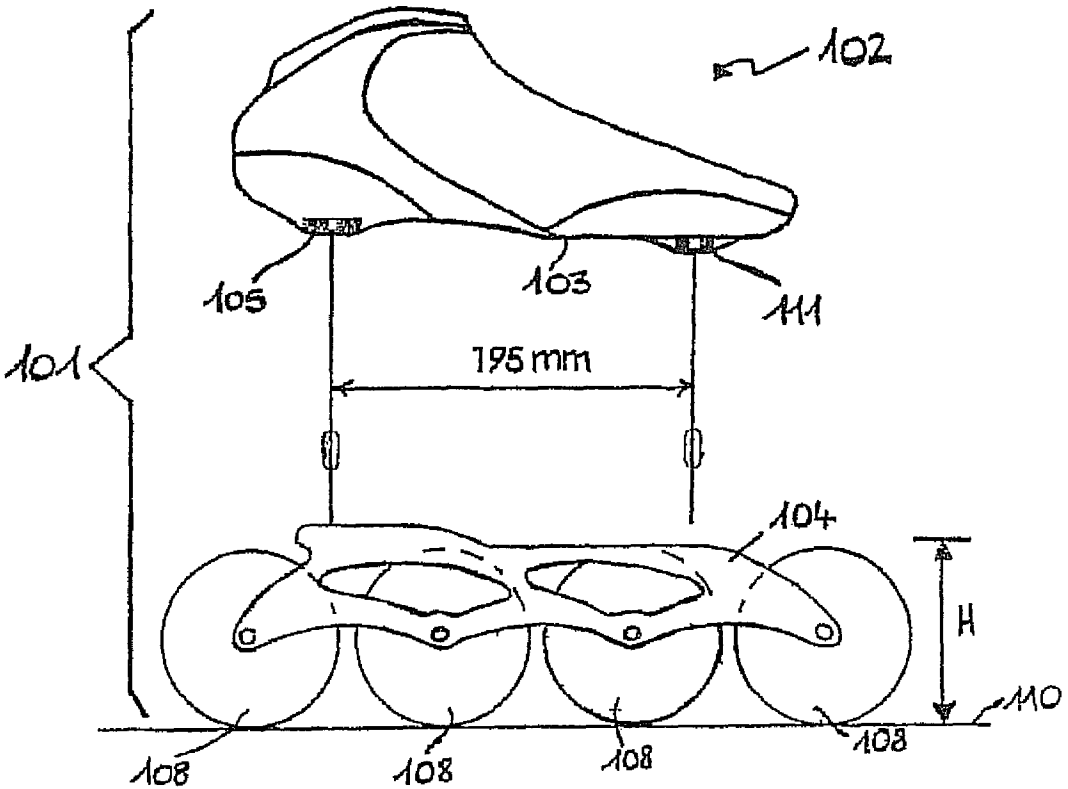
FIG. 1 (PRIOR ART)
FIG. 1 is a side view of an in-line roller skate of the prior art.
Figure 2:
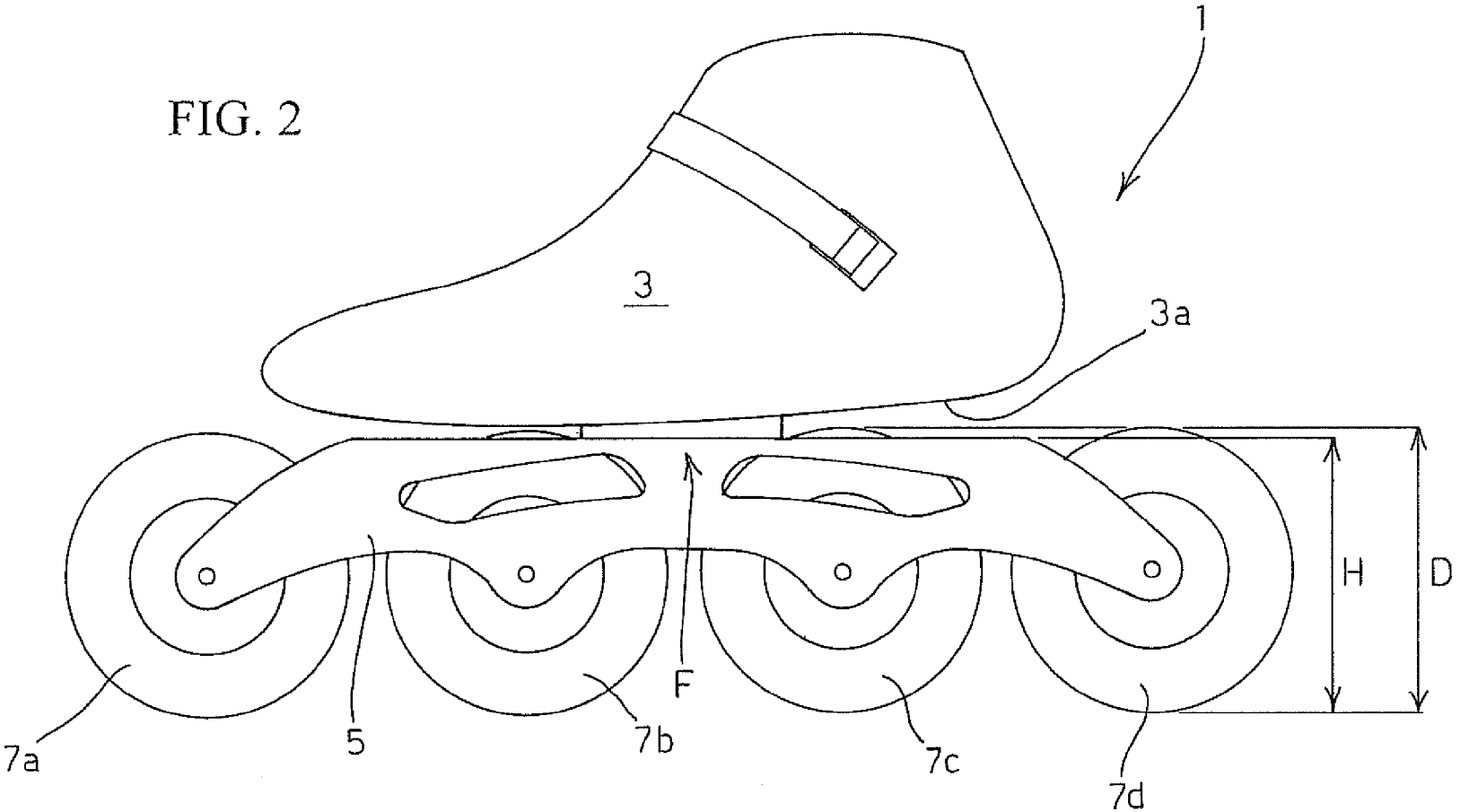
FIG. 2 is a side view of an in-line roller skate according to the invention.

With respect to known solutions of the kind depicted in FIG. 1, owing to the fact that the boot 3 is fastened to the frame at a unique fastening region F, which is central both relative to the boot 3 and to the frame 5, the stiffness of the skate 1 can be reduced, thus improving the precision in driving the skate, especially when turning.

Moreover, always thanks to the fastening at the central region F, provided at the gap between the central wheels, the distance of the boot 3—and, consequently, of the user's centre of gravity—from the sliding plane can be kept limited.

More particularly, as it is evident from the Figures, a skate 1 with a frame 5 having a vertical height H with respect to the sliding plane smaller than the diameter D of the wheels 7*a*-7*d* can be obtained.

For the above reasons, the invention can be particularly—but non exclusively—applied to racing skates, with aligned wheels having an increased diameter, for instance up to 100-110 mm.

Figure 3:
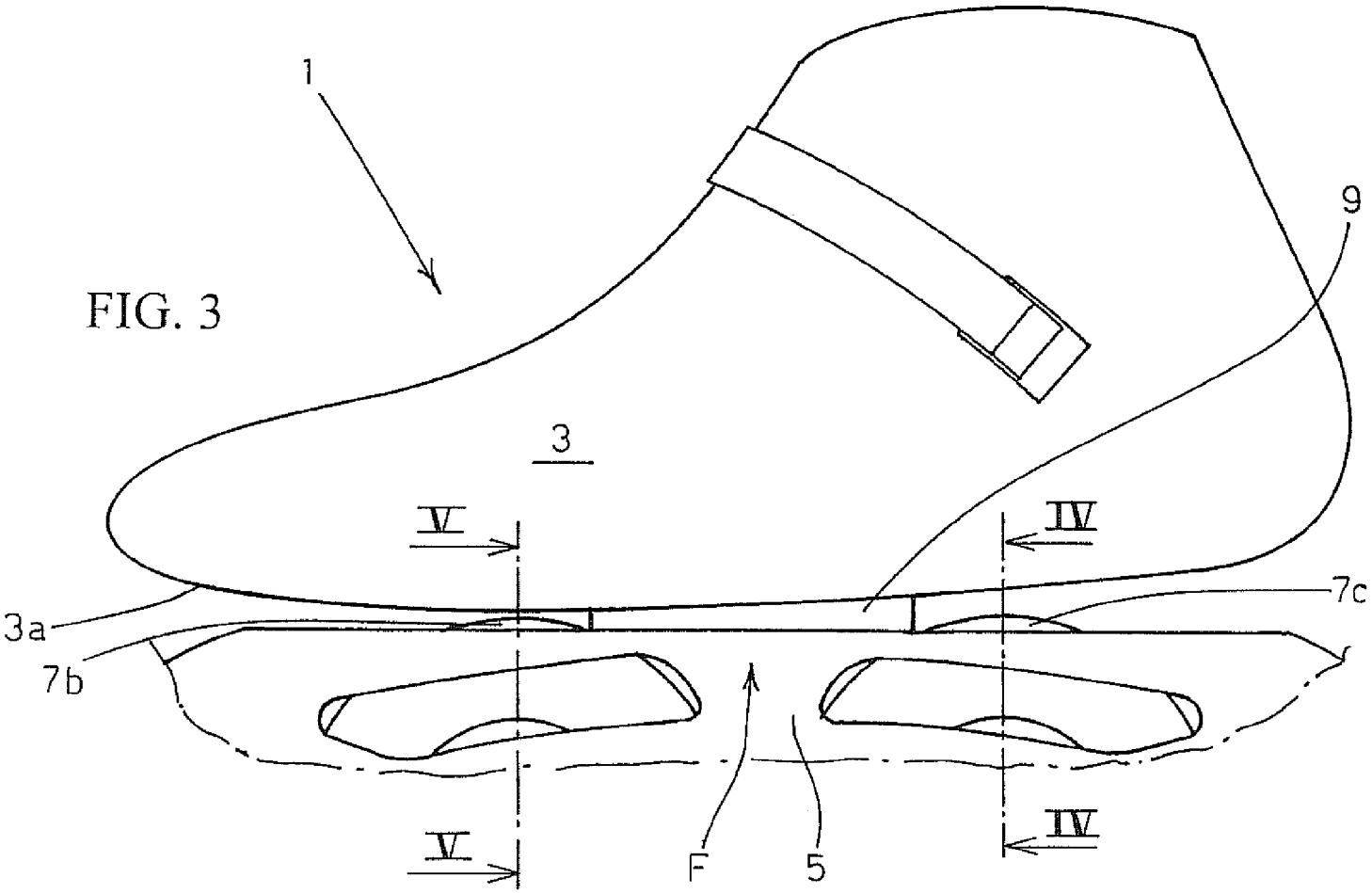
FIG. 3 is an enlarged view of a detail of FIG. 2.

With particular reference to FIG. 3, in the preferred embodiment the fastening portion of the boot 3 to the frame 5 comprises a support 9 integral to the boot 3 and fastened to the frame 5 at the fastening region F, for instance by means of screws or rivets.

Alternatively, it is evident that the support 9 could be integral to the frame 5 at this region F and fastened to the boot sole 3*a* by screws, rivets or the like.

Advantageously, the support 9 is substantially wedge-shaped, tapered towards the front portion of the frame, i.e. towards the toe region of the boot 3, thus guaranteeing a comfortable posture of the user's foot and allowing the optimum power transmission from the user to the skate.

Figure 4:
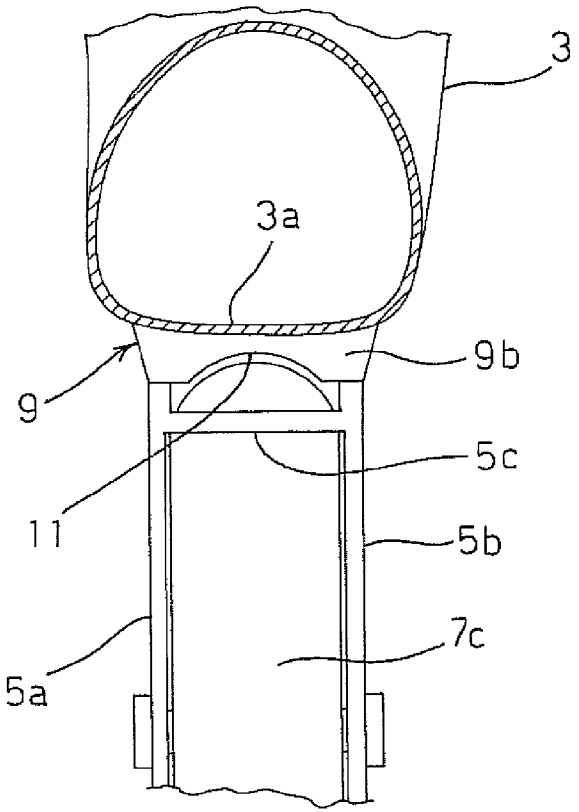
FIG. 4 is a cross-sectional view along line IV-IV of the skate of FIG. 2.

As shown in FIG. 4, the support 9 can be provided, along at least a portion of its length, with a curved cross-section so as to allow the passage of a portion of the wheels. More particularly, according to the illustrated embodiment, the rear portion 9*b* of the support 9 can advantageously include a lower curved recess 11 allowing to receive the upper portion of the wheel 7*c* and to reduce the distance of the sole 3*a* of the boot 3 from the sliding plane.

Figure 5:
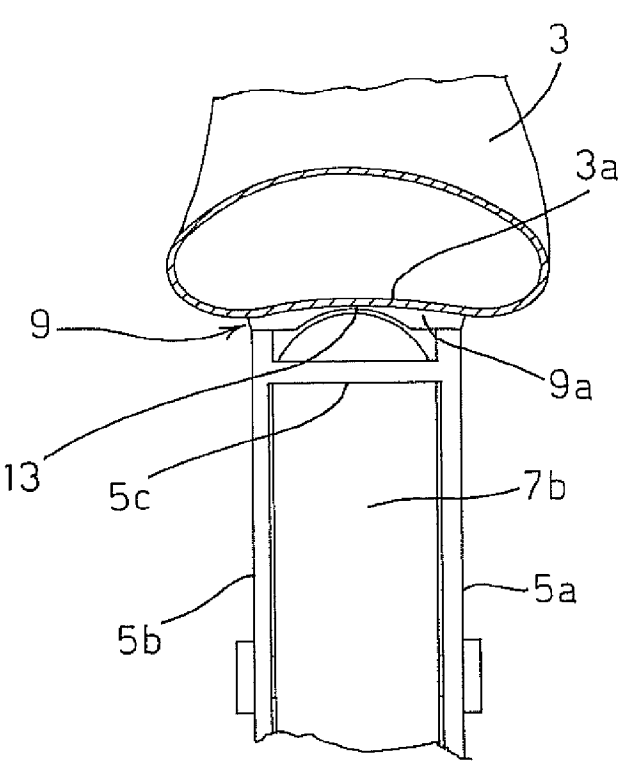
FIG. 5 is a cross-sectional view along line V-V of the skate of FIG. 2.

Analogously, as shown in FIG. 5, the front portion 9*a* of the support 9 can advantageously include a lower central recess 13 allowing to receive the upper portion of the wheel 7*b*.

Accordingly, the corresponding portion of the sole 3*a* of the boot 3 can have—if necessary—a slightly concave profile, always in order to receive the upper portion of the wheel 7*b*. It is evident from the above description that the invention allows to achieve the objects set forth above, since it provides a skate including a frame on which a plurality of wheels all having the same diameter (more particularly an increased diameter of 100-110 mm) can be mounted, wherein the distance of the user's centre of gravity from the sliding plane can be kept limited without excessively increasing the skate stiffness; thanks to the invention, it is possible to obtain at the same time improved performances both with respect to the stability of the skate and with respect to the precision in driving the skate, the speed and the vibration reduction.

Figure 6:
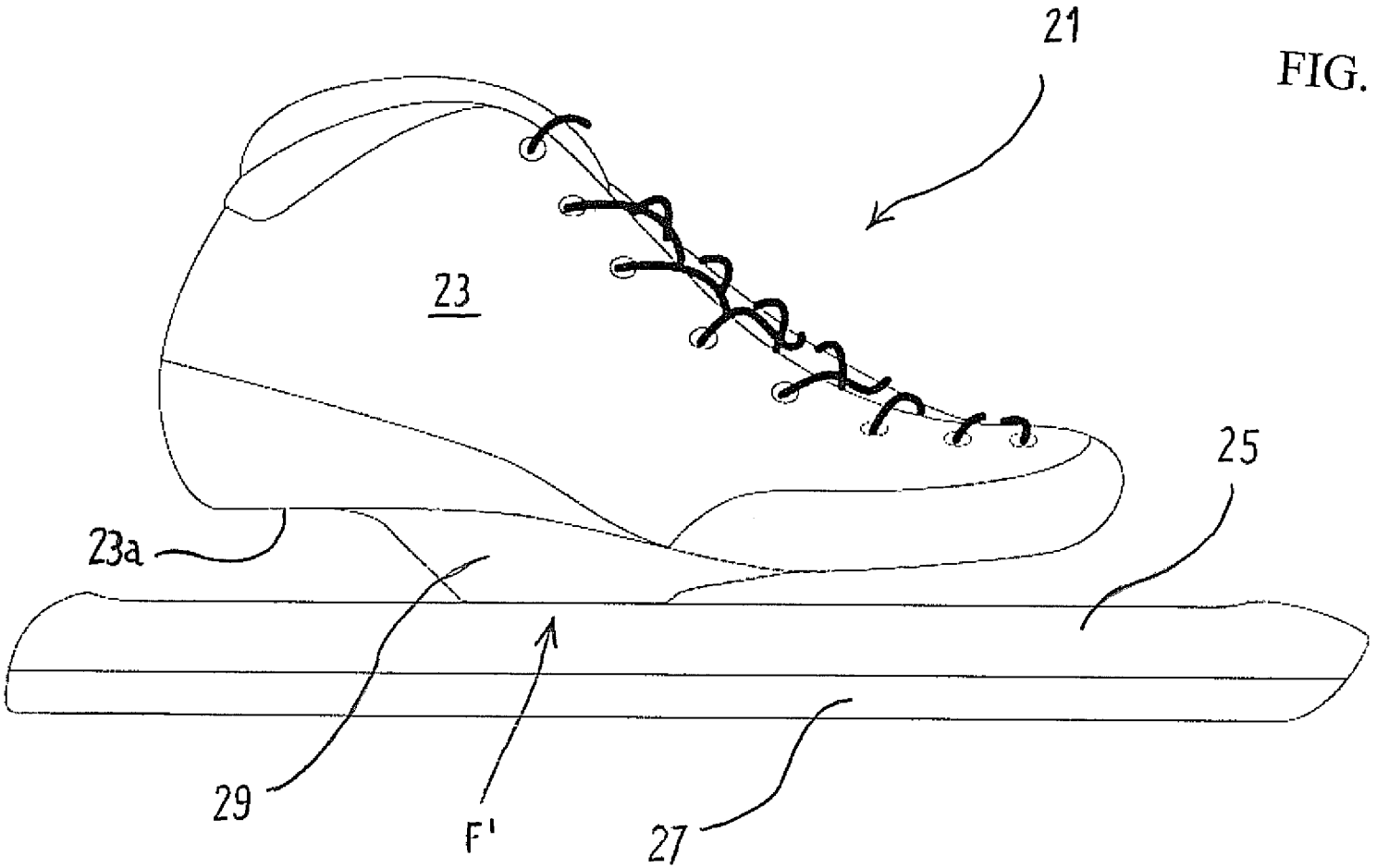
FIG. 6 is a side view of an ice skate according to the invention.

Turning now to FIG. 6, the ice skate 21 according to the invention comprises a frame 25 that is made of metal, for instance aluminium, and carries a blade 27 downwardly projecting from said frame.

A skate boot 23 provided with a sole 23*a* and suitable to be worn by the user of the skate 21 is fastened to said frame 25 through a fastening portion F'.

According to the invention, said fastening portion F' is fastened to the frame 25 at a region F' that is substantially central in the longitudinal direction between the front end of the blade 27 and the rear end of the blade 27.

According to this preferred embodiment of the invention, the boot 23 is fastened to the frame 25 exclusively through said central fastening portion F'.

With respect to known solutions wherein the boot is fastened to the frame both at the toe region and at the heel region, owing to the fact that the boot 23 is fastened to the frame at a unique fastening region F, which is central both relative to the boot 23 and to the frame 25, the stiffness of the skate 1 can be reduced, thus improving the precision in driving the skate, especially when turning.

Thanks to its reduced stiffness, the skate according to the invention can easily follow bends having small curvature radii. This is particularly advantageous, for instance, in short-track skates, since the arrangement of the invention allows to overcome the need of using curved blades for managing the small curvature radii of short-track rings.

However, it is to be noted that according to alternative embodiments of the invention, the boot could be fastened to the frame also through an additional fastening portion, namely at its toe region.

Such an alternative arrangement can be incorporated in ice skates for speed skating of the kind wherein the heel of the user can move away from the skate blade during skating.

In this kind of skates the boot is pivotally fastened to the frame at the additional fastening portion at the toe region and it is removably fastened to the frame at the fastening portion at the central region, so that the heel of the boot can move away from the skate blade during skating.

In this kind of skates, thanks to the arrangement according to the invention, not only the skate allows the user to easily manage bends having small curvature radii but it also provides improved performances in terms of power transmission and speed.

With reference back to FIG. 6, in the preferred embodiment the fastening portion of the boot 23 to the frame 25 comprises a support 29 integral to the boot 23 and fastened to the frame 25 at the fastening region F'.

Alternatively, it is evident that the support 29 could be integral to the frame 25 at this region F' and fastened to the boot sole 23*a* of the boot 23.

Advantageously, the support 29 is preferably tapered towards the front portion of the frame, i.e. towards the toe region of the boot 23, thus guaranteeing a comfortable posture of the user's foot and allowing the optimum power transmission from the user to the skate.

It will be evident to the person skilled in the art that although the ice skates depicted in FIG. 6 is a skate for speed skating, the invention can be advantageously incorporated in any kind of ice skates, comprising skates for figure skating.

In general, it will be evident that the skates described above with reference to the preferred embodiment of the invention have been given by way of mere example and that several variants and modifications can be made without departing from the scope of protection of the invention as defined in the appended claims.

For instance, the shape and the materials of the different components of the skate, namely of the skate boot and of the frame, can be chosen from time to time so as to accomplish as well as possible the specific needs of the manufacturer or of the user, without any prejudice to the invention.

The invention claimed is:

1. A skate comprising a frame, carrying one or more sliding elements, and a boot provided with a sole, said boot being fastened to said frame through a fastening portion, wherein said fastening portion is located between said sole and said frame in a substantially central region in the longitudinal direction of said frame, which substantially central region is central both relative to the longitudinal direction of said boot and to the longitudinal direction of said frame, and said boot is fastened to said frame exclusively at said fastening portion; wherein said fastening portion comprises a support; and wherein said support has a curved taper towards the front portion of said frame.

2. An ice skate comprising a frame, from which a blade downwardly projects, and a boot provided with a sole, said boot being fastened to said frame through a fastening portion, wherein said fastening portion is located between said sole and said frame in a substantially central region in the longitudinal direction between the front end of said blade and the rear end of said blade, which substantially central region is central both relative the longitudinal direction of said boot and to the longitudinal direction of said frame, wherein said boot is fastened to said frame exclusively at said fastening portion; wherein said fastening portion comprises a support; and wherein said support has a curved taper towards the front portion of said frame.

3. The ice skate according to claim 2, wherein said support is integral to said boot and fastened to said frame.

* * * * *